US007896786B1

(12) United States Patent
Osbourne

(10) Patent No.: US 7,896,786 B1
(45) Date of Patent: Mar. 1, 2011

(54) PORTABLE MODULAR EXERCISE APPARATUS FOR MULTIPLE USERS

(76) Inventor: Windell Osbourne, Newport News, VA (US)

( * ) Notice: Subject to any disclaimer, the term of this patent is extended or adjusted under 35 U.S.C. 154(b) by 0 days.

(21) Appl. No.: 12/551,275

(22) Filed: Aug. 31, 2009

(51) Int. Cl.
*A63B 21/02* (2006.01)
*A63B 71/00* (2006.01)
*A63B 1/00* (2006.01)

(52) U.S. Cl. ..... 482/122; 482/141; 482/38

(58) Field of Classification Search ..... 482/121–125, 482/129–130, 141–142, 148, 38–41, 23, 482/35–37
See application file for complete search history.

(56) References Cited

U.S. PATENT DOCUMENTS 1,495,536 A * 5/1924 Smith ..... 482/38
2,954,977 A * 10/1960 Durlacher ..... 482/36
3,874,657 A * 4/1975 Niebojewski ..... 482/104
4,241,914 A * 12/1980 Bushnell ..... 482/130
4,927,135 A * 5/1990 Nieppola ..... 482/41
5,029,850 A * 7/1991 van Straaten ..... 482/125
5,989,158 A * 11/1999 Fredette ..... 482/38
6,612,845 B1 * 9/2003 Macri et al. ..... 434/247
6,971,975 B2 * 12/2005 Croft ..... 482/121
7,309,303 B1 * 12/2007 Proctor ..... 482/121
2001/0004624 A1 * 6/2001 Cournoyer ..... 482/141
2004/0097333 A1 * 5/2004 Nappari ..... 482/41
2005/0192161 A1 * 9/2005 Bach ..... 482/39

* cited by examiner

*Primary Examiner*—Fenn C Mathew
(74) *Attorney, Agent, or Firm*—Donald W. Meeker

(57) ABSTRACT

A portable modular exercise apparatus for multiple users is separable into multiple components by pin connections. The modularity of the versatile exercise device enables numerous types of exercises by multiple users simultaneously. The apparatus comprises two upright support towers, a base with base pads under each support tower, an overhead crossbeam and a supplemental sliding push up cross bar, a number of resistance bands which attach to the apparatus for the purpose of resistance training, and a carrying bag to contain and transport all of the components. Pin connections allow the device to easily be assembled and taken apart without tools.

8 Claims, 10 Drawing Sheets

PORTABLE MODULAR EXERCISE APPARATUS FOR MULTIPLE USERS

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to exercise equipment and particularly to a portable modular exercise apparatus comprised of a plurality of components enabling numerous types of exercises by multiple users; the modular exercise apparatus comprises an overhead crossbeam, two upright support towers, a base support under each support tower, a base pad associated with each base support, and a supplemental sliding push up cross bar with handles, a plurality of resistance or tension bands which attach to the various components of the apparatus for the purpose of resistance training, and a carrying bag to contain and transport all of the components.

2. Description of Related Art Including Information Disclosed Under 37 CFR 1.97 and 1.98

Portable multi-purpose exercise devices which use elastic bands for resistive training are well known in the art. Likewise, large gym systems with multiple stations for multiple users are also abundant in the field. What is needed is a modular and portable multi-function multi-user exercise device which is separable into different components for different exercises so that a number of people can exercise at the same time by taking different components and performing different exercises with the components. The prior art fails to produce such a versatile exercise device.

U.S. Pat. No. 6,409,640, issued Jun. 25, 2002 to Cournoyer, describes an upper body exercise device having a pair of arcuate posts having lower footrests for resting on the ground, and a U-shape spacer bar, mounted to the top ends of the arcuate posts for free abutting against an upright wall. The two posts therefore remain substantially parallel to each other and to the upright wall. The posts are provided with notches distributed along their length, in a horizontally registering pair of which a push-up bar may be inserted for support of the push-up bar at a selected height over ground. The exerciser takes minimal ground space, yet allows many different types of exercises to be performed by an individual.

U.S. Pat. No. 1,104,505, issued Jul. 21, 1914 to Holworthy, provides a horizontal bar exercise apparatus which can be fitted in private houses. The apparatus comprises a base, standards projecting therefrom, a horizontal exercise bar connecting the standards and bracing members.

U.S. Pat. No. 5,536,222, issued Jul. 16, 1996 to Banda et al, shows a portable upper body exercise device designed to be used with a rod or a bar. The exercise device is lightweight and detachable. It does not require clamps or screws to secure it to a tabletop.

U.S. Patent Application #20090062087, published Mar. 5, 2009 by Poppinga, indicates an adjustable exercise apparatus that comprises a support component, first and second actuation elements, and first and second straps. The support component can be a belt or vest, for example, and can includes first and second ends that can be interconnected to form the support component in a loop. The first and second actuation elements are disposed along the support component and can be used to engage a portion of the respective first and second straps. Distal ends of each of the first and second straps can be engaged by a user for performing an exercise. In this regard, the straps can be at least partially elastically deformable. Further, the first and second actuation elements can be used to adjust the lengths of the straps to alter the tensile force exerted by the straps during exercise.

U.S. Patent Application #20070087920, published Apr. 19, 2007 by Dachraoui et al, puts forth a portable exercise device which has a generally rectangular, box-like main body in two portions, hinged together for opening and closing and having a storage area within. Recessed areas operable for attaching suitably equipped resistance tubing are disposed in an array that enables a variety of exercises.

Two U.S. Patent Applications, #20060160682 published Jul. 20, 2006 and #20060030463 published Feb. 9, 2006 by Maloy et al, concern a training device for exercising muscle groups of the entire body which comprises a portable rotating base which may have resistance bands attached for exercising the arms while twisting the body.

U.S. Patent Application #20030083178, published May 1, 2003 by Gilman, illustrates a portable functional training resistance apparatus used to exercise, rehabilitate and promote muscular strength and flexibility throughout the entire human body and a method for its use. This apparatus comprises a rigid base with a recess, strong enough to bear the weight of an adult exerciser who is standing, sitting, leaning, laying or vigorously moving about said base while performing exercises. The base is designed to receive various adaptors in the recess for the user to stand, sit, lean or lay on while performing exercises. The base has a plurality of attachment points, strategically placed on opposite sides of the recess, used to receive a means of resistance for exercise movements where added resistance is desired.

U.S. Pat. No. 6,186,930, issued Feb. 13, 2001 to Ignaczak, is for a push-up trainer having a base and a pair of handgrip assemblies. The handgrip assemblies are each slidably mounted to the base, allowing for lateral movement of the handgrips. Each handgrip assembly allows for rotation of each handgrip around a vertical axis and around its horizontal lengthwise axis. Each of the sliding and rotational motions may selectively be allowed or locked out using a spring biased pin.

U.S. Pat. No. 7,125,367, issued Oct. 24, 2006 to Stearns, shows a multi-purpose exercise apparatus. The exercise device includes a frame, and left and right force receiving members movably mounted on the frame. The force receiving members are selectively linked to one another to facilitate a first mode of exercise, wherein a person's hands or legs are repeatedly moved toward and away from one another. When so linked, the force receiving members may alternatively be biased toward one another or away from one another. The force receiving members may be decoupled to facilitate a second mode of exercise, wherein a person stretches and/or leans forward and then returns backward.

U.S. Pat. No. 5,226,868, issued Jul. 13, 1993 to Montgomery, claims an exercise device including a push-up board and two push-up handles. The two C-shaped push-up handles are mounted along various positions of the push-up board. Only one end of the C-shaped handles is located within symmetrically-spaced holes of the push-up board. Since only one end of the C-shaped handle is secured within the board and with the shape of the inserted handle end being round, the C-shaped handles are rotatable about the anchored end to provide a vast array of movement and varied exercise routines. A position most comfortable for the user is obtainable by rotation of the handle about the one end located in the push-up board. Numerous pre-set positions are available for doing push-ups to obtain a maximum health benefit from basic push-ups. Further, an adjustment is provided for maximum strength development and wrist comfort when doing difficult push-ups through a series of wide to narrow hand separation positions.

U.S. Pat. No. 5,205,802, issued Apr. 27, 1993 to Swisher, illustrates an exercise apparatus for providing improved muscle conditioning via push-ups or similar exercises. The apparatus comprises an elongated body with end supports and two rotatably affixed hand grips. The elongated body has a plurality of pairs of bushing lined holes. Each hole of each pair is equally spaced from the elongated body's vertical centerline. The hand grips are rectangularly shaped having a pin extension that slidably and rotatably fits in the body's bushing lined holes. The top horizontal portion of the rectangle is an ergonomically shaped handle. The pin and, consequently, the hand grip are locked into place in the body via a spring clip which engages the pin at its free end. The spring clip engages the underside of the body such that the hand grips cannot be withdrawn from the body until the clip is removed. While being used, the user grabs the ergonomically contoured handles and performs a push-up or similar exercise. The invention allows the user to properly space the hand grips for maximum comfort and variation of exercises. While pushing up and returning down, the user can rotate his hands and wrists through a mechanically limited range of motion as demanded by the body's natural tendency to do so during such an exercise.

U.S. Pat. No. 1,402,179, issued Jan. 3, 1922 to Piscitelli, relates an exercising harness which is worn on the back of the user and which has a series of elastic ropes slidably contained within cord holder on the back of the harness. The group of ropes has a handle at each end.

U.S. Pat. No. 5,916,070, issued Jun. 29, 1999 to Donohue, describes an exercise device for exercising a user's upper body including a U-Shaped guard mounted around a user's waist, a non-elastic cord extending around a central portion of the guard, guide means on said guard for positioning the cord to allow free longitudinal sliding movement and a hand hold at each end of the cord to allow the user to grasp one of the hand holds in each hand and force the cord to slide alternately in opposite directions along the guard.

U.S. Patent Application #20090082183, published Mar. 26, 2009 by Haynes, shows a vest in FIG. 5 which has a fastener on the back thereof for fastening to a pouch having connected resistance bands. The user may exercise using the resistance bands while the pouch remains in place by virtue of the attachment to the apparel.

U.S. Patent Application #20090062088, published Mar. 5, 2009 by Ismail et al, discloses a portable, light-weight exercise apparatus that includes a jacket or vest made light-weight material and coated with low surface friction coating, and can be worn on the user's upper body. The jacket having an upper protuberance member and a lower protuberance member, each with an aperture for engaging a pair of resistance cables that are respectively connected to a pair of grip handles. Depending on the desired exercise of certain muscle groups, the user engages resistance cables in either the lower protuberance member, or the upper protuberance member. In another embodiment, the jacket comprises of two track-like members means placed on the back-side of the jacket, for adjusting the resistance cables, and a single protuberance member where the resistance cables are secured therein.

U.S. Patent Application #20050148448, published Jul. 7, 2005 by Mersch, claims a push-up board portable exercise device having a base member and a plurality of handle grips. At least two of the handle grips are adjustable on the base member. The handle grips permit a user to exercise the chest muscles, shoulders, back, arms, and triceps of the user. The base preferably has a non-slip bottom creating a unit that will not tip over or slip.

U.S. Patent Application #20060128540, published Jun. 15, 2006 by Engle, discloses an apparatus for circuit and other fitness training which comprises a housing having an internal space wherein multiple resilient members, such as elastic cords or stretchable bands, are fully contained while in a rest state; an attachment point where each resilient member is securely affixed to the housing; and an aperture located substantially opposite the attachment point, through which resilient members are accessible, and to which a handle assembly is removably attached. A user may selectably attach the handle assembly to one or several resilient members in order to select the desired resistive force. Because resilient members are fully contained within the housing when in a rest state, the resilient members exert a resistive force immediately upon being extended from the aperture in the housing.

U.S. Pat. No. 7,488,282, issued Feb. 10, 2009 to Leavitt, is for an exercise device including an exercise platform and an incline base that can be used together or separately. The exercise device can be used for aerobics, strength-training and yoga or a combination thereof. The exercise platform can be rectilinear U-shaped and can include pull rings and exercise tubes connected thereto and the incline base can be adjustable from a horizontal position to variable degrees of incline.

U.S. Pat. No. 7,357,766, issued Apr. 15, 2008 to Langer et al, puts forth a body conditioning apparatus having a relatively rigid platform and a resilient elevating and locating member receivable in an opening at an elevated center of the platform for adapting the platform for use in balance enhancing exercises. The locating member includes a releasable grip configured to hold the apparatus at the selected surface without surface modification. At least one resiliently stretchable cord attachment may be received through circumferential openings in the platform.

U.S. Pat. No. 7,108,643, issued Sep. 19, 2006 to Wilson et al, provides a push-up device comprising an elongate floor-supported platform having sliding handgrips mounted thereon. In a preferred embodiment, the handgrips, which are constrained to move only along a track, which may be linear or curvilinear and lying in a substantially horizontal plane, are interconnected by linking means such as belts. The linkage is such that the handgrips remain equidistant from a fixed centerline midway between the handgrips throughout their range of motion. In the preferred embodiment, the linking means are belts that are supported by pulleys housed within the floor-supported platform. In yet a further embodiment, the platform includes wall and/or ceiling attachment means and can be employed for performing pull-ups.

What is needed is a multipurpose exercise device separable into multiple components by pin connections, which components are usable simultaneously by a number of different users on different components separable from the same device.

BRIEF SUMMARY OF THE INVENTION

An object of the present invention is to provide a multipurpose exercise device separable into multiple components by pin connections, which components are usable simultaneously by a number of different users on different components separable from the same device.

Another object of the present invention is to provide a carrying case to contain all the separated components.

One more object of the present invention is to provide pin connections to connect the various components.

An additional object of the present invention is to provide telescoping, adjustable towers for height adjustment.

A further object of the present invention is to provide hand grips that can slide or be secured in place on the auxiliary horizontal bar used for push ups.

In brief, the present invention comprises a portable modular exercise apparatus comprised of a plurality of components enabling numerous types of exercises by multiple users; the modular exercise apparatus comprises two upright support towers, a base under each support tower, an overhead crossbeam and a supplemental sliding push up cross bar, a plurality of resistance or tension bands which attach to the various components of the apparatus for the purpose of resistance training, and a carrying bag to contain and transport all of the components.

An advantage of the present invention is it provides a carrying case allowing for easy transport and storage of the device.

Another advantage of the present invention is it provides a means to connect and disconnect the various components without using tools.

One more advantage of the present invention is it provides adjustments for individuals of different heights.

An additional advantage of the present invention is it provides a means for sliding pushups.

A further advantage of the present invention is it provides adjustments that allow for various difficulty levels for users, from beginner to advanced.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
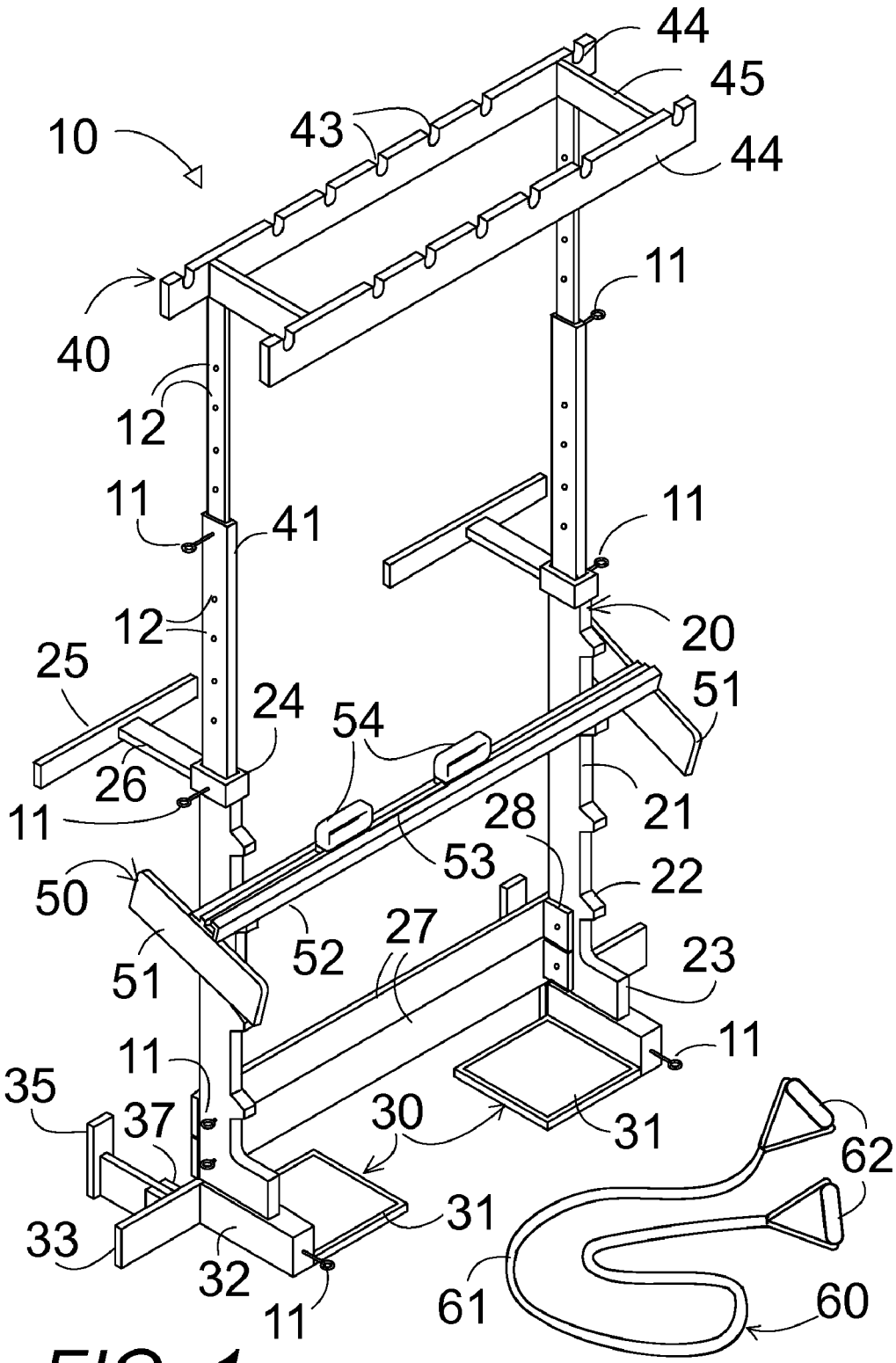
FIG. 1 is a perspective view of the modular portable exercise device of the present invention showing all of the components assembled for use.

In FIGS. 1-15, a portable multipurpose modular exercise device 10 is separable into multiple different modular exercise components by pin 11 connections, including a base stand 20, base pads 30 used with the entire device 10 or just the base stand 20 or separately on the floor, an auxiliary cross bar 50 used with the base stand 20 or on the floor, and an upper cross bar 40 supported by vertical tower posts 41 adjustably attached to the base stand 20. The modular exercise components are usable simultaneously by a number of different users working out on different modular exercise components separated from the same device, as shown in FIGS. 4-10.

In FIGS. 1-4, a base stand 20 comprises two spaced vertical base posts 21 interconnected by at least one horizontal support bar 27 removably attached between the two vertical base posts 21 and connected to each of the vertical base posts 21 by removable pins 11. The base posts 21 comprise a series of vertically spaced mating paired support brackets 22 to receive and support a modular component supported horizontally between one of the pairs of support brackets 22 at a time. The base posts 21 also comprise at least one pair of aligned horizontal brace brackets 26 with at least one on each of the base posts 21, extending between the base post 21 and an external vertical surface. The horizontal brace brackets 26 rest against the external vertical surface for support at least at the top of the base posts 21 and to space the base post away from the external vertical surface to allow a user to stand between the base posts 21. The pair of aligned horizontal brace brackets 26 further comprise a support bar 25 horizontally resting against the vertical surface (wall) to spread the load over two or more wall studs to prevent the brace brackets from going through the wall. Additionally, the base legs 32, 33, and 34 (base front leg, base side leg, and base back leg, respectively) stabilize the device 10 to keep it from tipping over or sliding. The base back foot 35 attached to the base back leg rests against the vertical surface (wall) for added stability after seating in the leg bracket 37 and secured by a pin 11.

Figure 2:
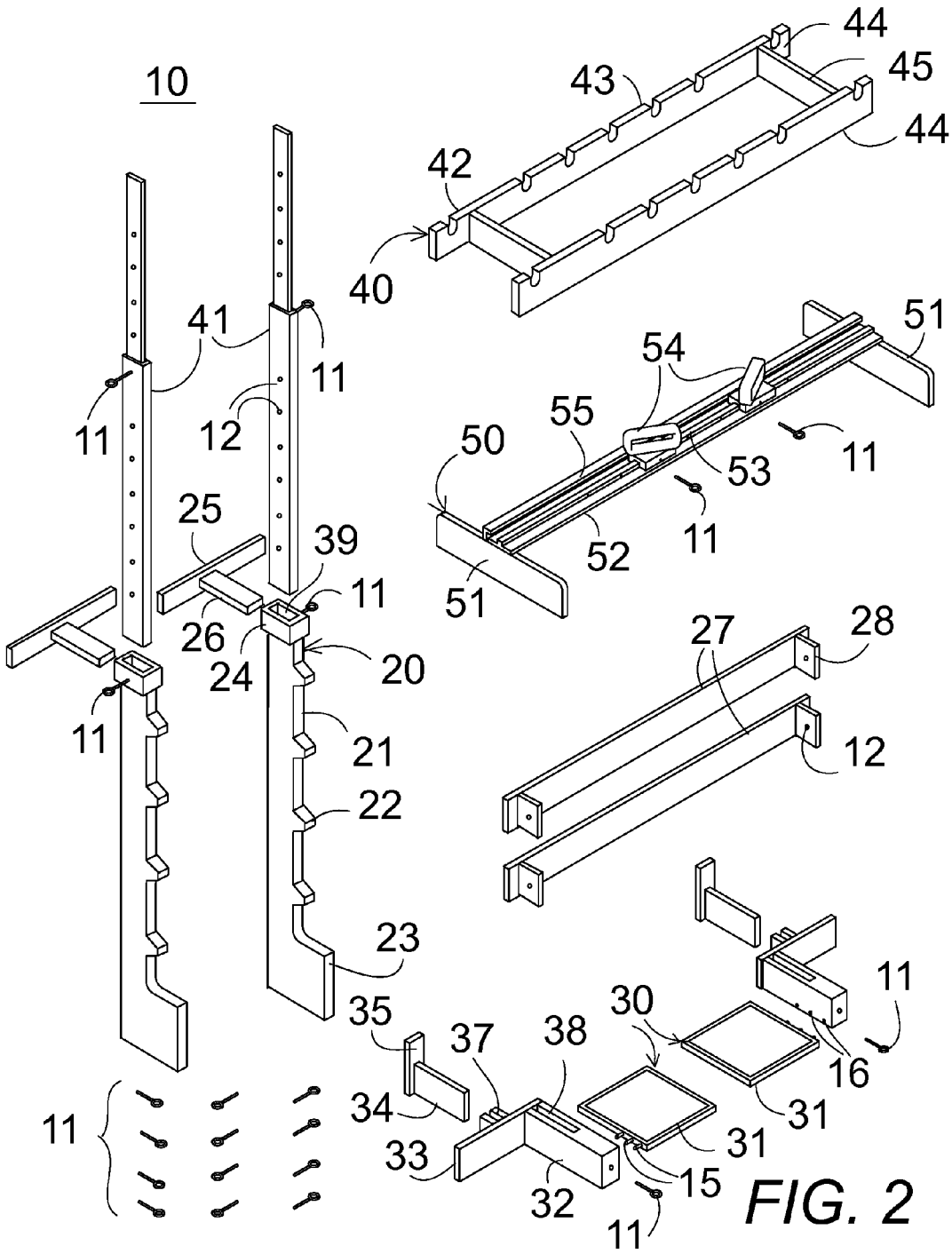
FIG. 2 is an exploded perspective view of the modular portable exercise device of the present invention showing all of the components separated for storage.
Figure 4:
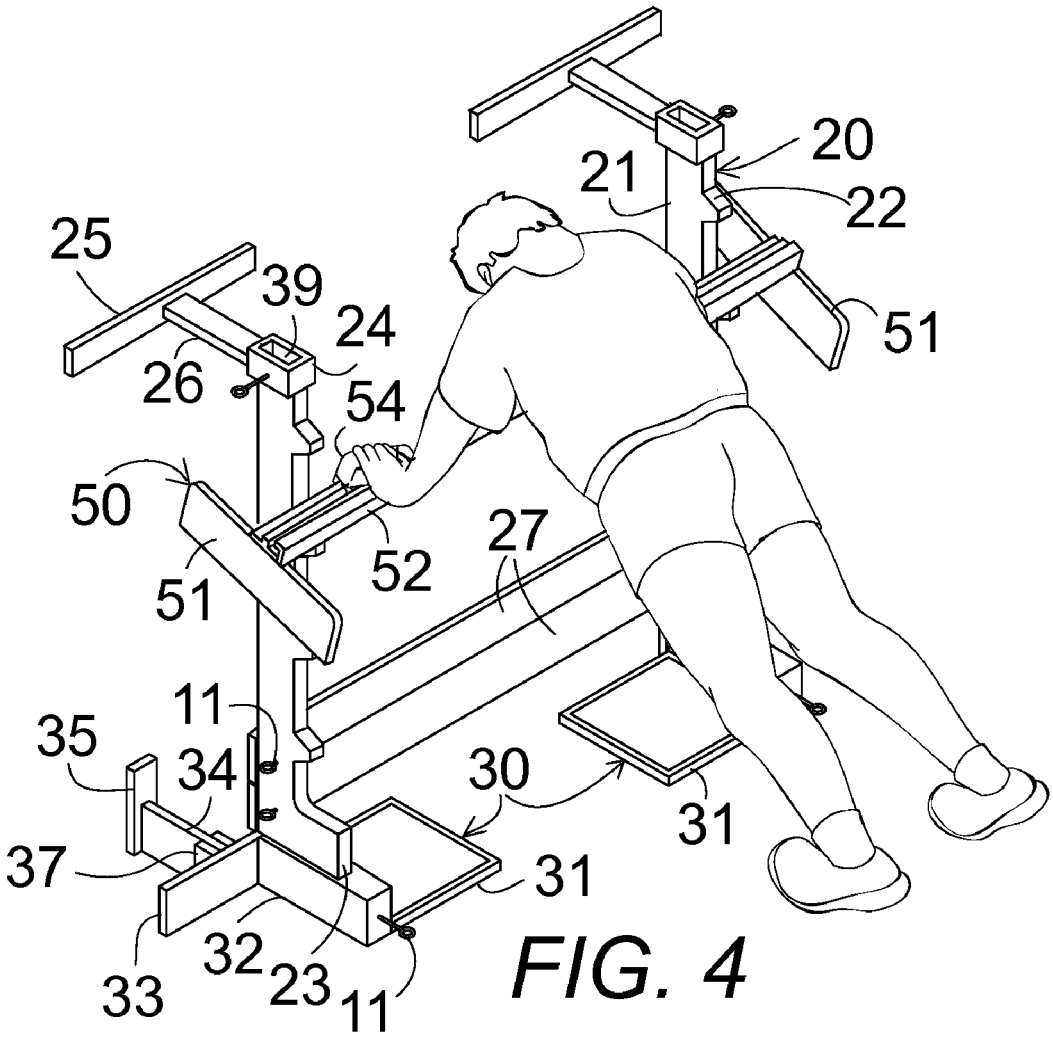
FIG. 4 is a perspective view of the base stand and base pads and auxiliary cross bar of the modular portable exercise device of the present invention showing a user performing push up exercises on auxiliary cross bar secured across two support brackets of the base stand.
Figure 5:
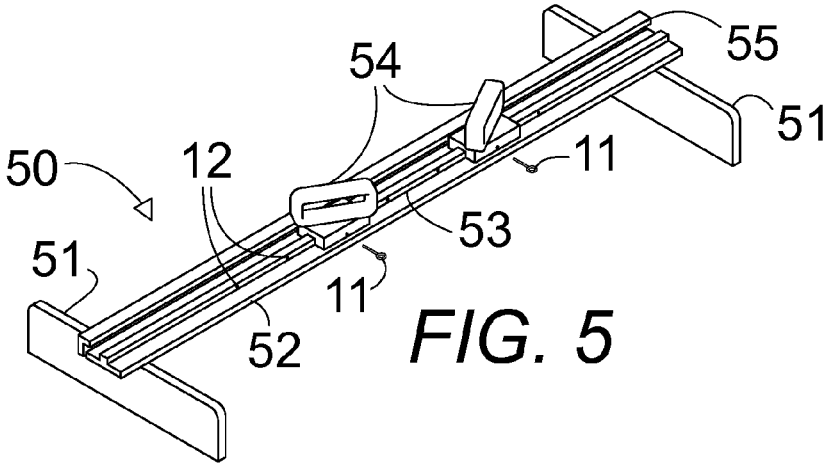
FIG. 5 is a perspective view of the auxiliary cross bar of the modular portable exercise device of the present invention showing the hand grips.
Figure 6:
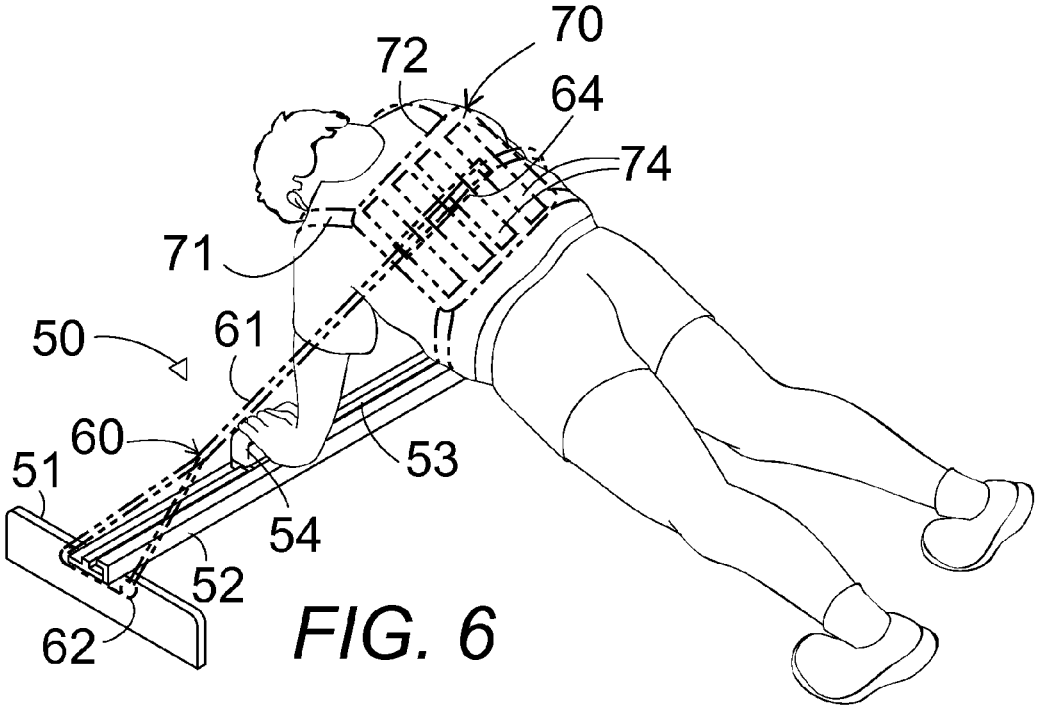
FIG. 6 is a perspective view of the auxiliary cross bar of the modular portable exercise device of the present invention resting on a floor surface showing a user performing push up exercises on the auxiliary cross bar resting on the floor, the user wearing an optional vest (shown dashed) and using an optional resistance or tension band secured between the back of the vest and the auxiliary cross bar for adding extra stress while performing push ups.
Figure 11:
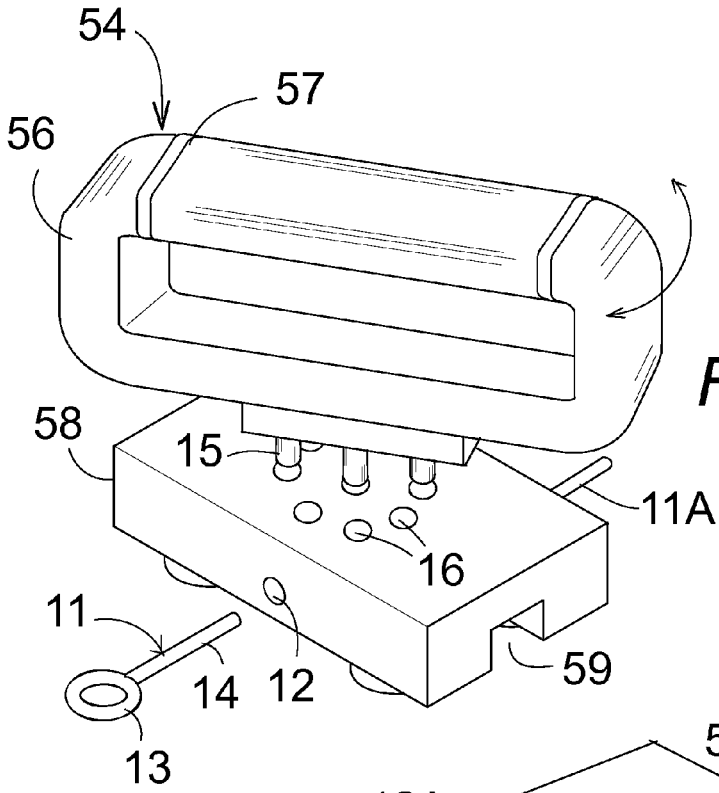
FIG. 11 is an enlarged perspective view of the hand grips for use with the auxiliary cross bar of the modular portable exercise device of the present invention showing the rotational adjustability of the hand grip.

In FIGS. 1, 2, & 4, a modular auxiliary cross bar 50 is removably attached by loop pins 11 between one pair of mating paired support brackets 22 at a time on the base posts 20. In FIGS. 5 & 6, the modular auxiliary cross bar 50 is alternately separated from the base posts 20 and positioned on a floor surface resting on a pair of downwardly extending feet 51, one at each end of a rigid horizontal bar 52. FIGS. 1, 2, 4, 5, & 6 show the auxiliary cross bar 50 comprising the rigid horizontal bar 52 having a pair of hand grips 54 slidably and pivotally attached to the auxiliary cross bar 50 so that the hand grips 54 may slide along a ridge 53 in the top of the auxiliary cross bar 50 at a selected angle for sliding exercises (as shown in FIGS. 2, 5, & 11), or may alternately be individually secured to the auxiliary cross bar 50 in a desired position and desired angle for non-sliding exercises using removable loop pins 11. The auxiliary cross bar 50, therefore, enables a user to perform a variety of exercises such as push ups, sliding push ups, and thrusts over a range of difficulty from easy to difficult, as the auxiliary cross bar 50 is positioned from a top pair of brackets 22 on the base posts 20, down to lower pairs of brackets 22, and to the floor (FIGS. 5 & 6).

Figure 3:
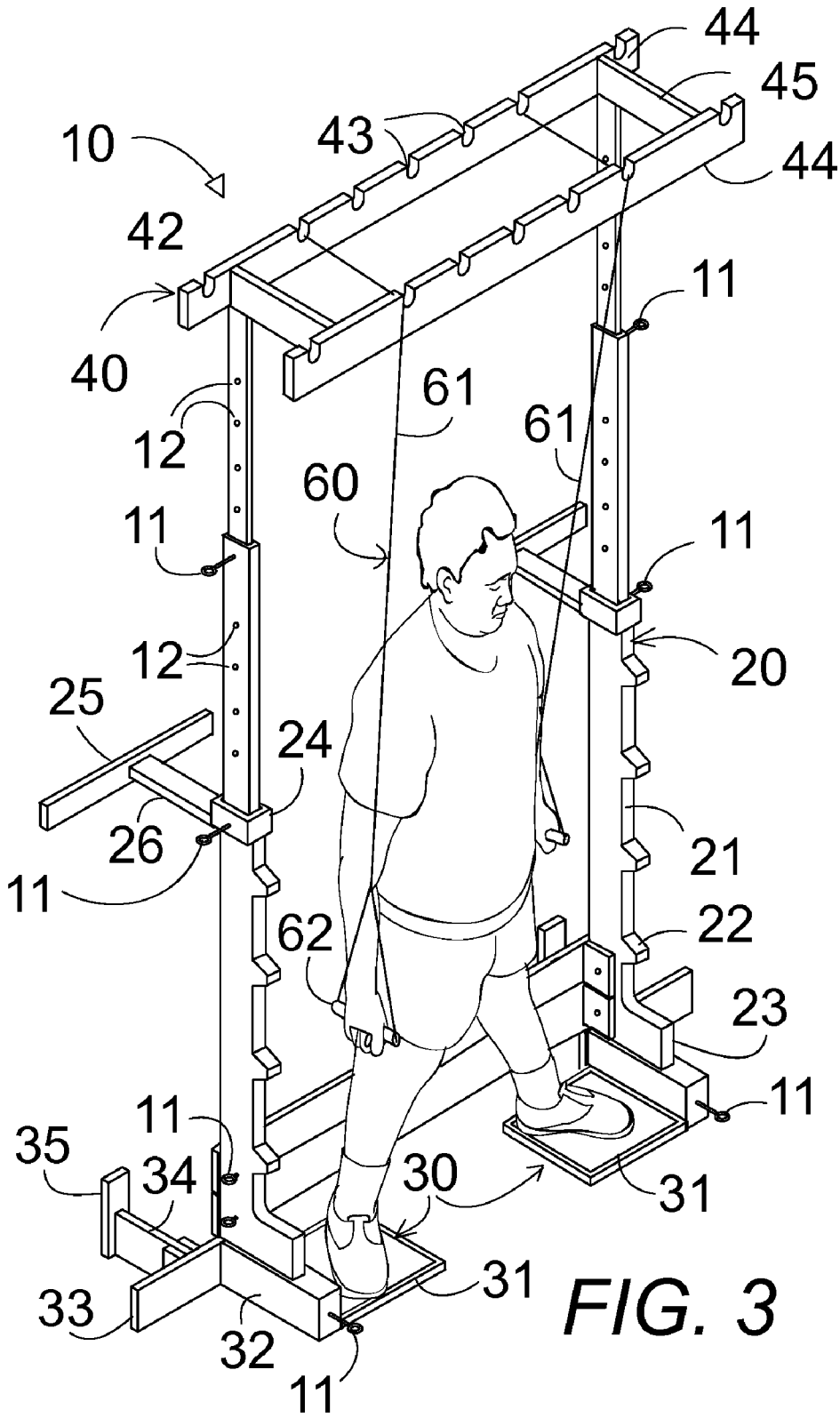
FIG. 3 is a perspective view of the modular portable exercise device of the present invention having all of the components assembled for use and showing a user performing pull down exercises on a resistance or tension band slung over the upper cross bar.

FIGS. 1-3 show a pair of vertical tower posts 41 each telescopically extending upwardly from a collar 24 on one of the base posts. An upper cross bar 40 is supported by the pair of vertical tower posts 41 with the upper cross bar 40 having a series of smooth gripping portions 48 for a user to grasp for pull ups and a series of notches 43 to receive at least one resistance band 60 for a user to perform a variety of pull down exercises. The vertical tower posts 41 are adjustable in height and adjust the height of the upper cross bar 40 to accommodate users of different heights and different exercises being performed using the upper cross bar.

In FIGS. 1-4 and 7, a pair of base pads 31 rests on a floor surface and are each removably connected to one of the base posts 20 by removable pin connections with a series of pad pins 15 in the base pad assembly 30 inserted into holes 16 in the base front leg 32. The base pads 31 comprise resilient support surfaces to support a user performing exercises, and as shown in FIGS. 7-10, the base front legs 32 have at least one opening in each of the legs 32 to receive a pin 11 for attaching at least one resistance or tension band 60 thereto for performing a variety of exercises using the base pads 31 in conjunction with other modular components or, alternately, using the pads 31 removed from the other modular components to perform a variety of upper body work and lower body work exercises.

In FIGS. 1-13, all of the modular components are removably interconnected by pins 11 through mating openings in the components so that the device 10 may be fully assembled for use or the modular components separated for use of the components by a number of different users simultaneously. The pin connections 11 allow the entire device 10 to be disassembled by hand without the use of tools and inserted into a carrier 80, as in FIG. 15, for transportation, thereby providing a portable, multipurpose, and modular exercise device separable into multiple, different exercise components. Thus a number of different users can be working out simultaneously on different exercise components separated from the same device.

In FIG. 1, the modular portable exercise device 10 is shown with all of the components assembled for use.

In FIG. 2, the modular portable exercise device 10 is shown with all of the components separated for storage.

In FIG. 3, the modular portable exercise device 10 is shown having all of the components assembled for use and also shows a user performing pull down exercises on a resistance band 60 slung over the upper cross bar 40.

In FIG. 4, the base stand 20, base pads 30, and auxiliary cross bar 50 of the modular portable exercise device 10 are shown with a user performing push up exercises on the auxiliary cross bar 50 secured across two support brackets 22 of the base stand 20.

In FIG. 5, the auxiliary cross bar 50 of the modular portable exercise device 10 is shown with the hand grips 54.

In FIG. 6, the auxiliary cross bar 50 of the modular portable exercise device 10 is shown resting on a floor surface with a user performing push up exercises on the auxiliary cross bar 50, the user wearing an optional vest 70 (shown dashed) and using an optional resistance band 60 secured between the back of the vest 70 and the auxiliary cross bar 50 for adding extra stress while performing push ups.

Figure 7:
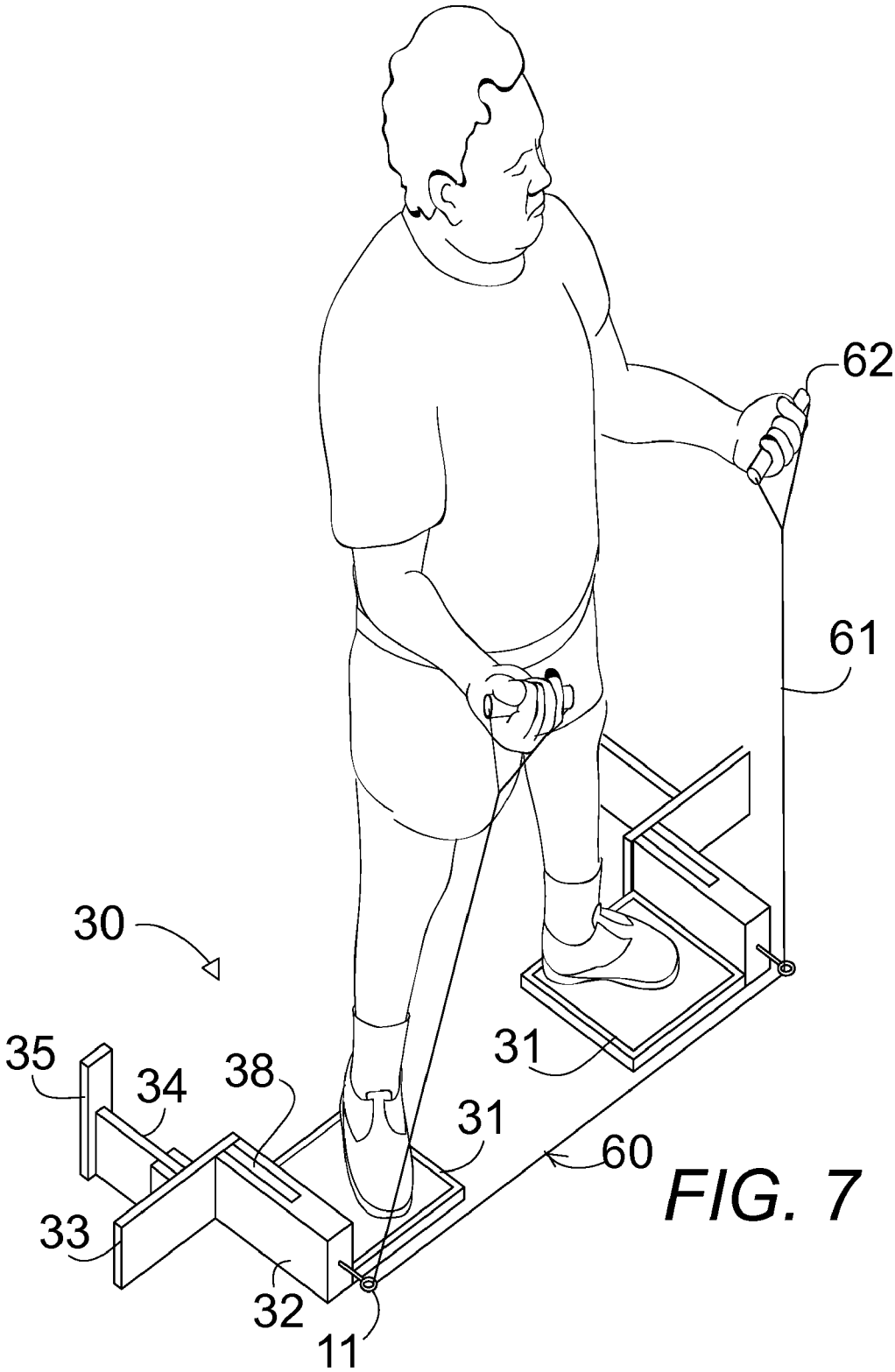
FIG. 7 is a perspective view of the base pads of the modular portable exercise device of the present invention showing a user performing lifting exercises on a resistance or tension band attached to the base pad assembly.

In FIG. 7, the base pads 31 of the modular portable exercise device 10 are shown with a user performing lifting exercises on a resistance band 60 attached to the base pad assembly 30.

Figure 8:
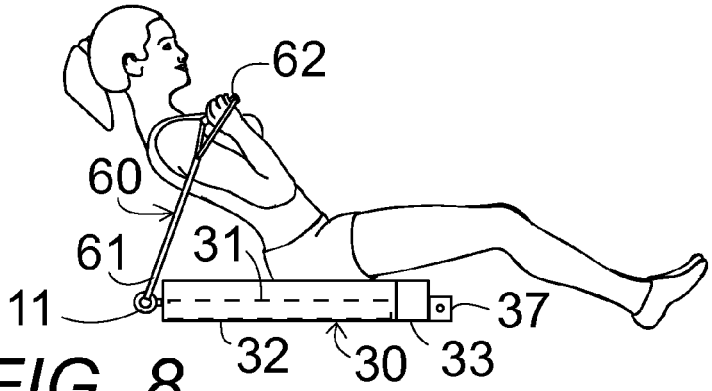
FIG. 8 is a side elevational view of a base pad assembly of the modular portable exercise device of the present invention showing a user sitting on the base pads performing sit up exercises on a resistance or tension band attached to the base pad assembly.

In FIG. 8, the base pad assembly 30 of the modular portable exercise device 10 is shown with a user sitting on the base pads 31 performing sit up exercises on a resistance band 60 attached to the base pad assembly 30.

Figure 9:
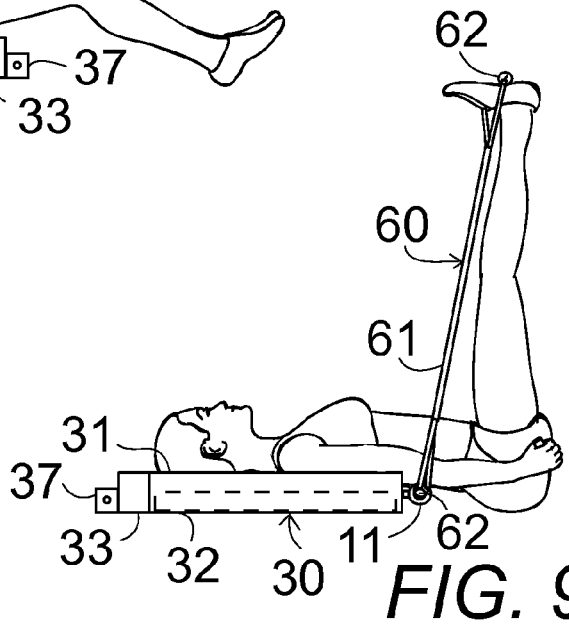
FIG. 9 is a side elevational view of a base pad assembly of the modular portable exercise device of the present invention showing a user laying back on the base pads performing leg extension and arm extension exercises on resistance or tension bands attached to the base pad assembly.

In FIG. 9, the base pad assembly 30 of the modular portable exercise device 10 is shown with a user laying back on the base pads 31 performing leg extension and arm extension exercises using resistance bands 60 attached to the base pad assembly 30.

Figure 10:
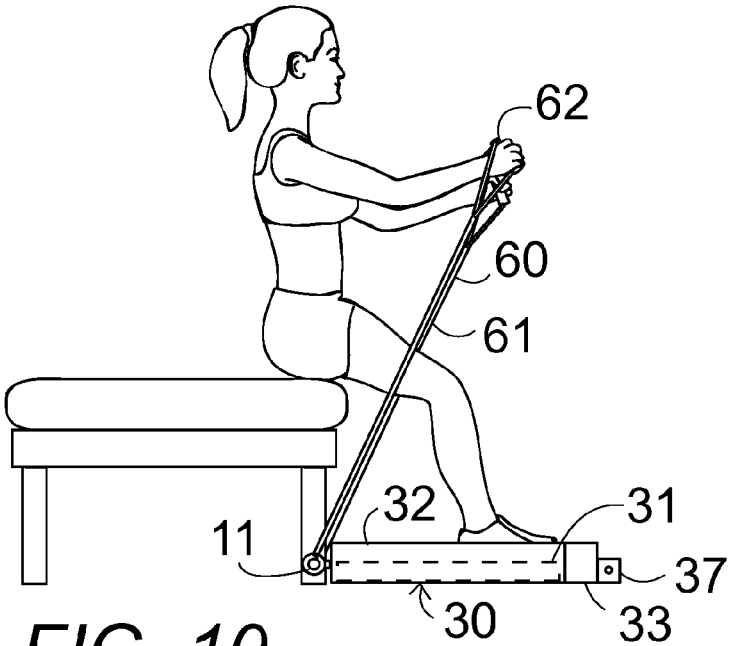
FIG. 10 is a side elevational view of a base pad assembly of the modular portable exercise device of the present invention showing a user sitting on any external surface performing arm lift exercises on a resistance or tension band attached to the base pad assembly.

In FIG. 10, the base pad assembly 30 of the modular portable exercise device 10 is shown with a user sitting on any external surface performing arm lift exercises using a resistance band 60 attached to the base pad assembly 30.

In FIG. 11, the rotational adjustability of the hand grips 54 used with the auxiliary cross bar 50 is shown. The hand grips 54 are adjusted by inserting the hand grip 56 with the high friction grip surface 57 into the hand grip base 58 by fitting the pins 15 in the hand grip 54 into the center hole and selected pairs of the circular array of holes 16 on the top of the hand grip base 58. The circular array of holes 16 in the hand grip base 58 allow for a variety of angular positions for the hand grip 54. The groove 59 through the bottom of the base 58 slides over the linear ridge 53 of the auxiliary cross bar 50 to adjust the location of each of the hand grips 54 with a pin 11 inserted through the opening 12 in each hand grip and into one of a spaced linear array of mating holes in the linear ridge 53 and also to permit sliding pushups or other exercises with the hand grip sliding freely on the linear ridge 53 and pins inserted just in two outer openings in the linear ridge to act as stops to limit the outer range of sliding motion of the hand grips. The enlarged view of a first pin 11 shows the pin shaft 14 inserted in the openings to assemble components of the device 10 and a finger loop 13 for easy extraction of the pin 11 to disassemble the components of the device 10.

Figure 12:
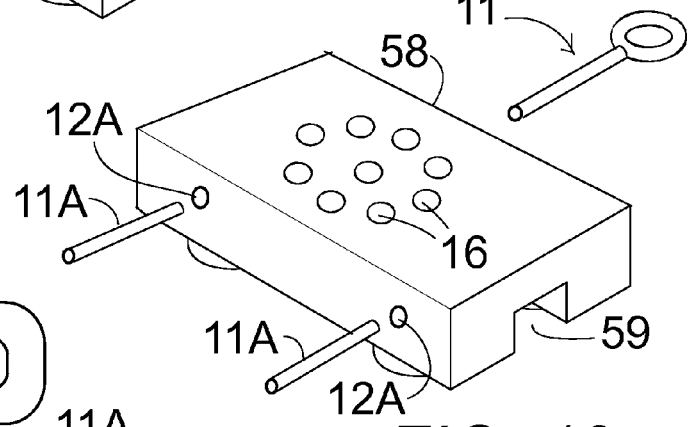
FIG. 12 is an enlarged perspective view of the hand grip base of FIG. 11 showing a back side of the hand grip base with two spaced openings to receive insertable straight pins for use with the overhanging ridge of the auxiliary cross bar when performing sliding push ups or other sliding exercises.
Figure 13:
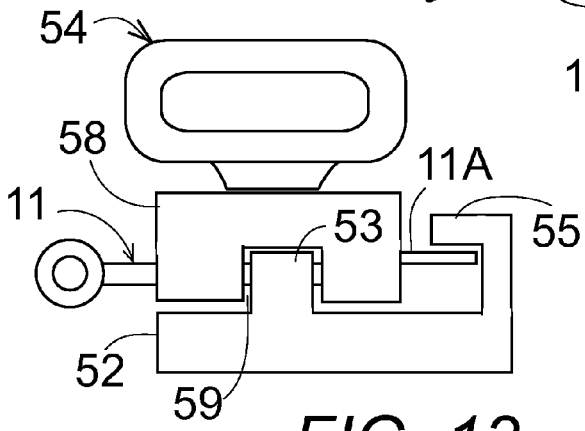
FIG. 13 is an end elevational view of the hand grip of FIG. 11 showing the insertable straight pins riding under the overhanging ridge of the auxiliary cross bar when performing sliding push ups or other sliding exercises.

In FIGS. 12 and 13, a pair of straight pins 11A mount on the opposite side of the hand grip base 58 removably insertable in a pair of spaced openings 12A in each hand grip base 58 so that the second pair of straight pins 11A ride under the overhanging ridge 55 along the length of the horizontal bar 52 to retain the hand grips on the linear ridge 53 while a person is performing sliding push ups or other exercises using the sliding motion along the auxiliary cross bar.

Figure 14:
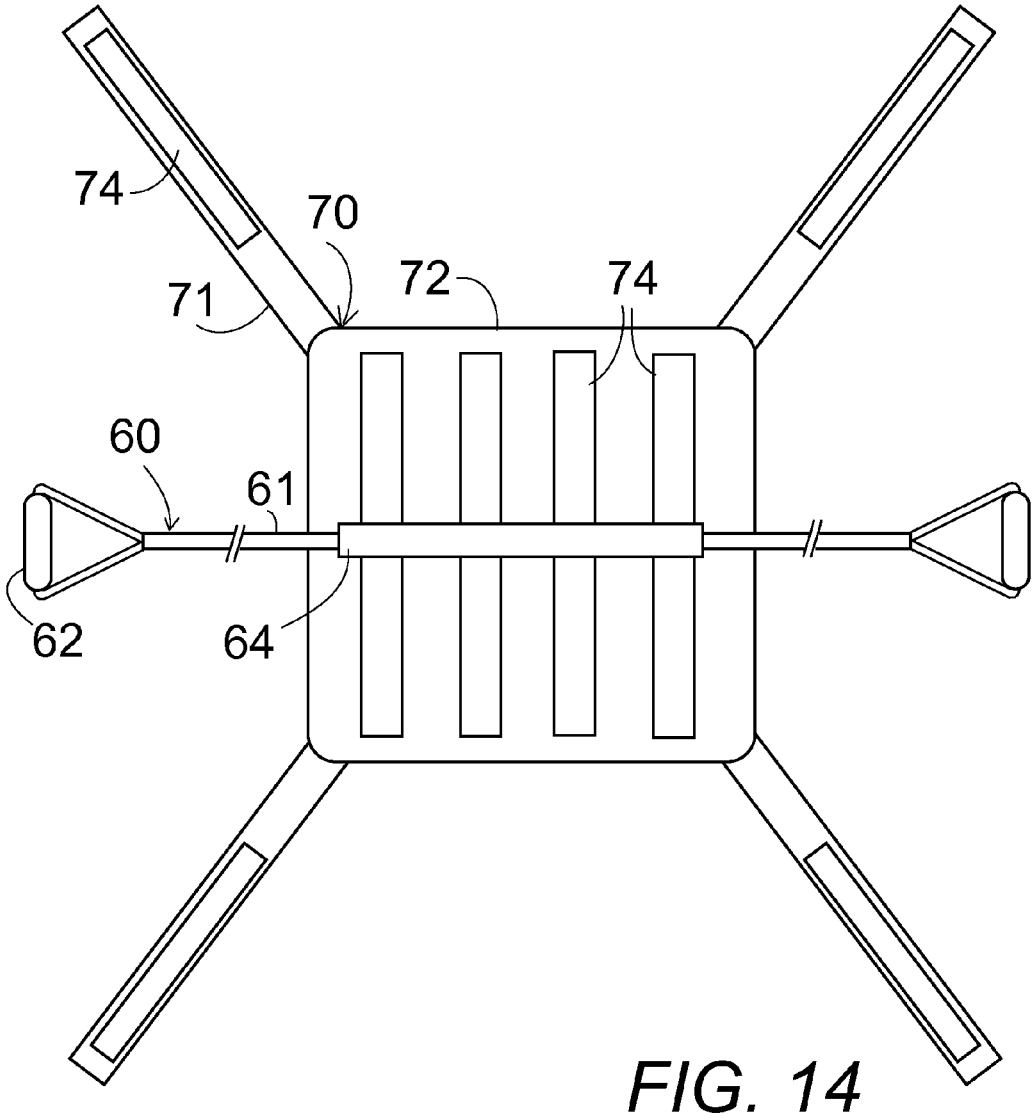
FIG. 14 is a plan view of the optional vest and optional resistance or tension band secured between the back of the vest and to be used with the auxiliary cross bar of the modular portable exercise device of the present invention resting on a floor surface for adding extra stress while performing push ups.

In FIG. 14, the optional vest 70 and the optional resistance band 60 secured between the back of the vest is shown being used with the auxiliary cross bar 50 of the modular portable exercise device 10 resting on a floor surface for adding extra stress while performing push ups.

In FIG. 6, the vest 70 is shown worn by a user with the vest comprising adjustable straps 71 to support the vest 70 on the user and the means for attaching at least one resistance band 60 to the vest 70 and then between the vest and the auxiliary cross bar 50 to increase the stress on user doing push ups on the auxiliary cross bar 50.

In FIGS. 6 and 14, the means for attaching the at least one resistance band to the vest 70 is shown comprising mating hook and loop fasteners between hook and loop fastener strips 74 on a back surface 72 of the vest 70 and a mating hook and look fastener sleeve 64 on the resistance band 60 which is stretched between two ends of the auxiliary cross bar 50 with each handle 62 of the resistance band hooked over one end of the auxiliary cross bar 50 and over the back surface of the vest 70 of the user with mating hook and loop fasteners therebetween.

Figure 15:
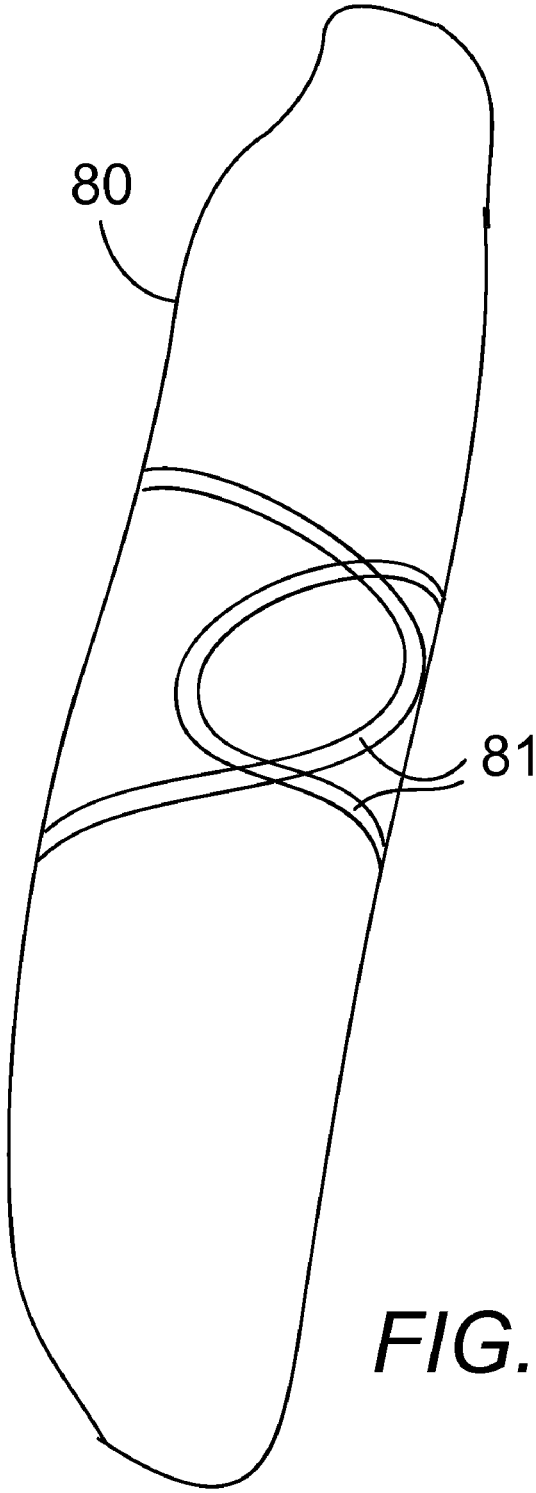
FIG. 15 is a perspective view of the storage and carry bag of the modular portable exercise device of the present invention used to carry all of the separated parts shown in FIG. 2.

In FIG. 15, the storage and carry bag 80 for the modular portable exercise device 10 is used to carry all of the separated parts shown in FIG. 2. The bag 80 has straps 81 that allow for easy carrying.

In FIGS. 1-3, the upper cross bar 40 is shown comprising a pair of horizontal parallel spaced members 44 having notches 43 spaced apart along a top surface of each of the members 44. A resistance band 60 is wrapped around a pair of the spaced members 44 and secured in the notches 43 to increase the stress of the exercise.

In use, the modular components of the present invention 10 can be separated out and used independently with tension straps (also called resistance bands) 60 attached to them for both upper body work and lower body work, as well as work as a regular work out bench, as in FIG. 10. While one user worked out on the base pads 30 doing various exercises, as in FIGS. 7, 8, 9 and 10, another user could work out on the auxiliary cross bar 50 as in FIG. 6, and another user could work out on the upright apparatus 10 using the upper cross bar, as in FIG. 3, minus the base pads 30.

In the fully assembled upright configuration of FIG. 1, tension straps 60 can connect to the upper cross bar 40 above the shoulders and pulled down to simulate the exercise for the arms performed when doing pull ups. Pull ups can also be performed on a smooth hand receiving part 48.

The portable modular exercise apparatus 10 is comprised of a plurality of components enabling numerous types of exercises by multiple users. The modular exercise apparatus 10 comprises two upright support towers 41 a base 20 under each support tower, an overhead crossbeam 40 and a supplemental sliding push up cross bar 50, a plurality of resistance bands 60 which attach to the various components of the apparatus for the purpose of resistance training, and a carrying bag 80 to contain and transport all of the components.

The device 10 is a multi-function, multi-user exercise device which is separable into different components for different exercises so that a number of people can exercise at the same time by taking different components and performing different exercises with the components. The device when assembled stands higher than a person with the two tall towers 41, the base 20, and base pads 31 resting on the ground and several support brackets 25 and 35 resting against a wall. All of the components attach adjustably together using pins 11 with finger pull rings 13 inserted in different holes 12 to adjust the height or width of the different components. No tools are required. The exercise device allows for a complete range of users from beginners to advance fitness users by adjusting the different components.

The tower components 20 and 41 telescope up or down to adjust for different individuals of different heights. The upper cross bar 40 is supported by two telescoping towers to adjust the height of the upper cross bar 40. In the fully assembled upright configuration of FIG. 3, tension straps 60 (also called resistance bands) can connect to the upper cross bar 40 above the shoulders to be pulled down to simulate the pull up exercise for the arms. The straps may be attached near the outer ends of the upper cross bar for doing resistance pec (pectoral muscle) pull downs, as in FIG. 3. And the tension of the straps 60 can be increased by winding them around the upper cross bar. Also the upper cross bar 40 may be adjusted in height, by altering the height of the towers 41 which telescope up, to allow different users of different heights to reach up to the upper cross bar and perform actual pull ups holding onto the smooth hand grip 48 portion of the cross bar 40.

The base bars or stand 20, which can be separated from the two towers, have notches or support brackets 22 to receive an auxiliary cross bar 50 (advance bar) for performing push ups or sliding push ups with the auxiliary cross bar 50 mounted in notches 22 at different heights so that at the highest point, a beginner can do push ups leaning against the wall at a slight angle from the vertical or do other exercises, such as leg thrusts at various angles depending on the height of the auxiliary cross bar. The handles 54 slide in the auxiliary cross bar and can slide freely for sliding push ups or be secured at any desired distance apart for still push ups. The auxiliary cross bar 50 can be separated from the combined device 10 and used independently on the floor for horizontal push ups, either regular push ups at different arm widths or sliding push ups. For advanced fitness users, a vest 70 with hook and loop fastener strips 74 (shown horizontally, but preferably should be attached vertically on the back of the vest) receives a tension or resistance strap 60 with a mating hook and loop fastener covering 64 connecting the strap to the back of the vest 70 and further connecting to the auxiliary cross bar 50 to create additional tension resistance on the user performing pushups on the bar shown in use with the bar.

The base pads 31 can be separated out and used independently with tension or resistance straps 60 attached to them to include upper body work and lower body work, and work as a regular work out bench as in FIG. 10.

It is understood that the preceding description is given merely by way of illustration and not in limitation of the invention and that various modifications may be made thereto without departing from the spirit of the invention as claimed.

What is claimed is:

1. A portable multipurpose modular exercise device separable into multiple different modular exercise components by pin connections, which modular exercise components are usable simultaneously by a number of different users working out on different modular exercise components separated from the same device, the device comprising:

a base stand comprising two spaced vertical base posts interconnected by at least one horizontal support bar removably attached between the two vertical base posts connected to each of the vertical base posts by removable pins, the base posts comprising a series of vertically spaced mating paired support brackets to receive and support another modular component supported horizontally between one of the pairs of support brackets at a time; and at least one pair of aligned horizontal brace brackets, at least one on each of the base posts, extending between the base post and an external vertical surface to rest against the external vertical surface for support at least at a top of the base posts and to space the base post away from the external vertical surface to allow a user to stand between the base posts;

a modular auxiliary cross bar removably attached by removable pins between one pair of mating paired support brackets at a time on the base posts and alternately separated from the base posts and positioned on a floor surface, the auxiliary cross bar comprising a rigid horizontal bar having a pair of hand grips slidably and pivotally attached to the auxiliary cross bar so that the hand grips may slide along the auxiliary cross bar at a selected angle for sliding exercises or may alternately be individually secured to the auxiliary cross bar in a desired position and desired angle for non-sliding exercises, so that the auxiliary cross bar enables a user to perform a variety of exercises such as push ups, sliding push ups and thrusts over a range of difficulty from easy to difficult as the auxiliary cross bar is positioned from a top pair of brackets on the base posts down to lower pairs of brackets and to the floor;

a pair of vertical tower posts each telescopically extending from one of the base posts; an upper cross bar supported by the pair of vertical towers, the upper cross bar having a series of smooth gripping portions for a user to grasp for pull ups and a series of notches to receive at least one resistance strap for a user to perform a variety of pull down exercises, the vertical tower posts adjustable in height to adjust the height of the upper cross bar to accommodate users of different heights and different exercises being performed using the upper cross bar;

a pair of base pads resting on a floor surface and each removably connected to one of the base posts by removable pin connections, the base pads comprising resilient support surfaces to support a user performing exercises, the base pads having at least one opening in each of the base pads to receive a pin for attaching at least one resistance band thereto for performing a variety of exercises using the base pads in conjunction with other modular components or alternately using the pads removed from the other modular components to perform a variety of upper body work and lower body work exercises;

wherein all of the modular components are removably interconnected by pins through mating openings in the components so that the device may be fully assembled for use, the modular components separated for use of the components by a number of different users simultaneously, and the entire device disassembled by hand without the use of tools and inserted in a carrier for transportation, thereby providing a portable multipurpose modular exercise device separable into multiple different exercise components by pin connections, which different exercise components are usable simultaneously by a number of different users working out on different exercise components separated from the same device.

2. The device of claim 1 further comprising a vest worn by a user, the vest comprising adjustable straps to support the vest on the user and means for attaching at least one resistance band to the vest for use with the auxiliary cross bar with the at least one resistance band attached between the vest and the auxiliary cross bar to increase the stress on user doing push ups on the auxiliary cross bar.

3. The device of claim 2 wherein the means for attaching the at least one resistance band to the vest comprises mating hook and loop fasteners between a back surface of the vest and a resistance band stretched between two ends of the auxiliary cross bar and over the back surface of the vest of the user with mating hook and loop fasteners therebetween.

4. The device of claim 1 wherein the upper cross bar comprises a pair of horizontal parallel spaced members having notches spaced apart along a top surface of each of the members, wherein a resistance band is wrapped around the pair of spaced members and secured in the notches to increase the stress of the exercise.

5. The device of claim 1 wherein the at least one pair of aligned horizontal brace brackets further comprises a support bar horizontally resting against a wall to spread the load over two or more wall studs to prevent the brace brackets from going through the wall.

6. The device of claim 1 wherein each of the hand grips comprises a hand grip loop removably inserted into a hand grip base, the hand grip loop comprising a pair of spaced pins protruding from the bottom thereof and a center pin between the spaced pins and the hand grip base having a circular array of holes on a top surface thereof to receive the spaced pins from the hand grip loop alternately in different pairs of holes on opposite sides of the circular array for varying the angle of the hand grip loop relative to the hand grip base and having a center hole to receive the center pin to maintain the hand grip loop centered over the hand grip base.

7. The device of claim 1 wherein each of the hand grips comprises a groove through the bottom of the base and the auxiliary cross bar comprises a linear ridge mating with the groove along the length of the auxiliary cross bar so that the hand grip slides along the linear ridge of the auxiliary cross bar to adjust the location of each of the hand grips with a pin inserted through an opening in each hand grip and into one of a spaced linear array of mating holes in the linear ridge and further to permit sliding pushups and other exercises with the hand grip sliding freely on the linear ridge and pins inserted just in two outer openings in the linear ridge to act as stops to limit the outer range of sliding motion of the hand grips.

8. The device of claim 7 wherein the auxiliary cross bar further comprises an overhanging ridge running along the length of the auxiliary cross bar facing the linear ridge and a back side of the hand grip base has two spaced openings to receive insertable straight pins for use with the overhanging ridge of the auxiliary cross bar when performing sliding push ups and other sliding exercises to prevent the hand grip from slipping off of the protruding ridge.

* * * * *